United States Patent [19]

Harr et al.

[11] Patent Number: 4,686,994

[45] Date of Patent: Aug. 18, 1987

[54] REMOVABLE ARCH SUPPORT

[76] Inventors: George B. Harr, 744 Obispo Ave., Long Beach, Calif. 90804; Ronald W. Smith, 3131 Lama Ave., Long Beach, Calif. 90808

[21] Appl. No.: 597,358

[22] Filed: Apr. 6, 1984

[51] Int. Cl.[4] ..... A43B 7/14

[52] U.S. Cl. ..... 128/586; 128/80 D; 128/166.5

[58] Field of Search ..... 128/80 D, 586, 166.5

[56] References Cited

U.S. PATENT DOCUMENTS

| | | | |
|---|---|---|---|
| 1,907,136 | 5/1933 | Weitsen | 128/586 |
| 2,096,563 | 10/1937 | Schell | 128/586 |
| 2,454,836 | 11/1948 | Rayner | 128/80 D |
| 2,475,417 | 7/1949 | Wysowski | 128/586 |
| 2,633,130 | 3/1953 | Schell | 128/80 D |
| 2,668,375 | 2/1954 | Ward | 128/586 |
| 2,917,846 | 12/1959 | Schell | 128/586 |
| 3,086,520 | 4/1963 | Schell | 128/80 D |
| 3,265,071 | 8/1966 | Kirchner et al. | 128/586 |

*Primary Examiner*—William R. Dixon, Jr.
*Assistant Examiner*—Cynthia A. Prezlock
*Attorney, Agent, or Firm*—Romney Golant Martin Seldon & Ashen

[57] ABSTRACT

The arch support device is in the form of a removable shoe insert which is a substantially rigid thin unitary member truncated at both ends to fit between the heel and ball of the foot without underlying either one. A central arch portion is supported from a peripheral base means and is cantilevered for positioning above the shoe shank to present a concave support arm in the transverse direction and a convex support arm in the longitudinal direction. The arch support device extends substantially the full breadth of the plantar surface of the foot to be interposed between the midfoot and shoe insole.

12 Claims, 6 Drawing Figures

FIG. 1
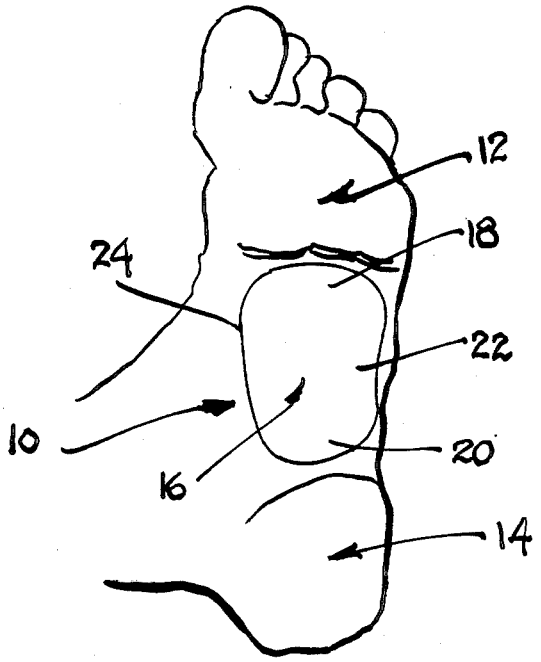
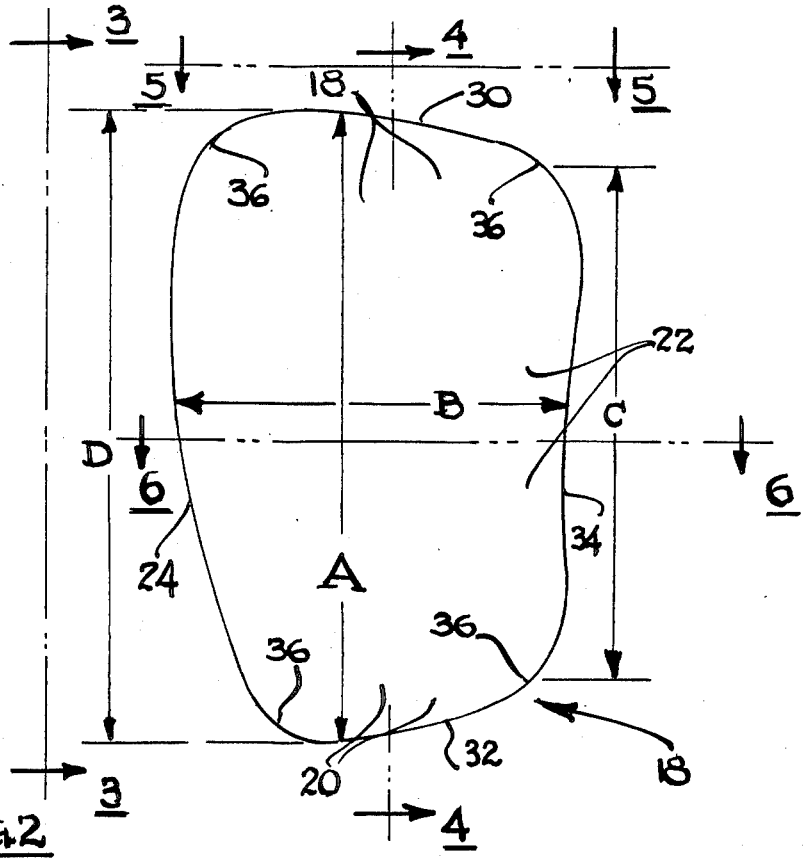
FIG. 2

REMOVABLE ARCH SUPPORT

This invention applies generally to remedial and preventive foot disorder products, and more specifically to removable arch supports insertable in shoes for temporary and/or permanent use by persons having arch and other foot problems who want to continue an active life with minimal discomfort or physiological injury.

Traditional methods of supporting the arch of the foot have included taping, reinforced shoes, shoes with built-in arch supports and insertable arch supports. Taping is only a short-term solution for people who need extra support for the arch of the foot. Frequent applications of tape is time-consuming and eventually irritating to the skin. The reinforced shoe is exessively expensive and while it may resist the deformity which occurs in shoes of people who have collapsing arches, it does little by itself to limit the collapsing of the arch which occurs during walking or running. Pads inserted into a reinforced shoe have some benefit in limiting collapse of the arch. However, the reinforced shoes are relatively heavy and available in few styles, making them unattractive to a large number of potential wearers.

With the growing popularity of conditioning sports, particularly running and aerobics, the athletic shoe industry has marketed numerous built-in arch supports. Though these built-in supports in athletic shoes have benefited some persons with mild arch-collapsing problems, the supports are inherently soft and inadequate in sufficiently limiting arch collapse for persons with moderate and severe problems.

Insertable arch supports (often called orthotic devices, orthoses or orthotics—particularly when custom-made) are in wide use among people with collapsing arch and other foot and leg pain problems. These devices have the advantage of being transferable to different pairs of shoes. The supports can be soft or rigid with intermediate variations. In general, the soft orthotics are more comfortable but give less support than the rigid devices.

The largest group of persons who need arch supports are those with flat feet or hyperpronation. Pronation is the tendency for the arch to depress during walking; it's a shock absorption mechanism and is coordinated with a twisting motion that the leg goes through during normal walking and running. Hyperpronation is excessive pronation. Discomfort in the arch of the foot is common in persons with hyperpronation because excessive repetitive stress is placed on joints and ligaments in the midpart and hind-part of the foot. Leg fatigue and discomfort is also common in people with hyperpronation because there is an overuse of leg muscles which involuntarily resist the repetitive depression of the arch.

The most common objective of arch supports is to relieve the fatigue and discomfort that occurs in hyperpronating persons during walking and running. In some instances, arch supports are prescribed after bunion surgery because hyperpronation can lead to recurrence of bunion deformities. Arch supports are also used in some instances of pain under the heel. The orthotic device can provide pressure in the arch of the foot which dissipates some of the force generated by the muscles in the sole of the foot. This pressure in the arch is thought to reduce the tension forces on the heel bone where the muscles attach and, thereby, relieve some of the pain associated with plantar fasciitis and heel spurs. Pain in the ball of the foot may be relieved with arch supports by dispersing weight-bearing forces over the whole plantar portion of the foot instead of concentrating those weight-bearing forces on just the ball of the foot and heel.

Most orthotic shoe inserts now on the market extend through at least two-thirds of the length of the foot, from the back of the heel to just behind the ball of the foot (the level of the metatarsal heads). Also, some actually extend under the entire length of the foot. The support of such orthotic inserts under the heel of the foot has always been thought to be necessary for stabilizing the orthosis, and particularly preventing the orthosis from tilting by rotating around its longitudinal axis. However, there are many problems which have arisen from the use of full length or heel length orthotics, including discomfort and difficulty in becoming accustomed to the device in the shoe and accepting it for daily use. Structurally the long foot orthosis is subject to many stresses including twisting and compression. This require that it be made unduly thick and bulky in order to withstand the stresses. When placed within a conventional shoe, the increased thickness and bulk add to the discomfort.

The invention of this patent application has been developed on the premise that if an orthosis is to be effective, it must be comfortable enough to be worn regularly by the user. The traditional elongated bulky and thickened arch supports have not adequately met this requirement. It is a primary object of the present invention to eliminate the aforementioned disadvantages of the prior foot orthosis and provide an improved device which eliminates the heel extension altogether, without sacrificing the stability of the device during use. A related object is to provide an orthosis that is significantly more comfortable, better accepted by the patient, and effective in treating the symptoms incurred from flat or hyperpronating feet and other conditions mentioned previously.

Another important object is to provide a device having the aforementioned characteristics which minimized any interference with the normal transfer of weight through the ball and heel of the foot to the underlying shoe insole. In that regard, it is intended to design an improved orthosis which covers less than sixty percent (60%) of the underside of the foot (plantar portion) and which is truncated at its forward end to terminate posterior to the heads of the first and fifth metatarsals to leave the ball of the foot in contact with the shoe insole without any interference, and which is also truncated at its rearward end to terminate anterior to the plantar prominence of the calcaneus to leave the heel of the foot in contact with the shoe insole, therby eliminating interference with the heel during walking, running and the like. A limited amount of natural flexibility is retained in the foot by virtue of the relatively short length of this orthosis.

Still a further object is to provide an improved device as described which also is relatively thin, particularly at its edges, to eliminate unnecessary bulk under the instep to provide a central arch portion in the orthosis which is cantilevered from base supports around the periphery of the device so as to span any crown in the shoe or shoes in which it is inserted.

Still another important object is to provide compound curvature of the device, particularly a combined concave/convex curvature in the central arch portion to minimize the risk of fracture or other failure.

A further important object is to contour the edge of the device around its perimeter by tapering the thickness along the edge to enhance the comfort of the device. A related object is to simplify the device to make it adaptable for comfortable use in most conventional but differently styled shoes.

Yet another important object is to provide a stabilizing extension to extend the full breadth of the plantar portion so as to be interposed under the lateral side which constitutes the weight-bearing portion of the midfoot, to help position the device and to help prevent it from tilting medially like a teeter-totter as the medial arch depresses against the improved orthotic device.

These and other objects will become evident to those skilled in the art, based on the following description of a presently preferred and illustrative embodiment of the invention, in cojunction with the accompanying drawings.

In the drawing:

FIG. 1 is a perspective view of a presently preferred embodiment of the arch support device showing its positioning under the instep of a left foot (with the shoe and sock not shown for clarity);

FIG. 2 is a bottom plan view of the device of FIG. 1;

DETAILED DESCRIPTION OF THE EXEMPLARY EMBODIMENT

Figure 3:
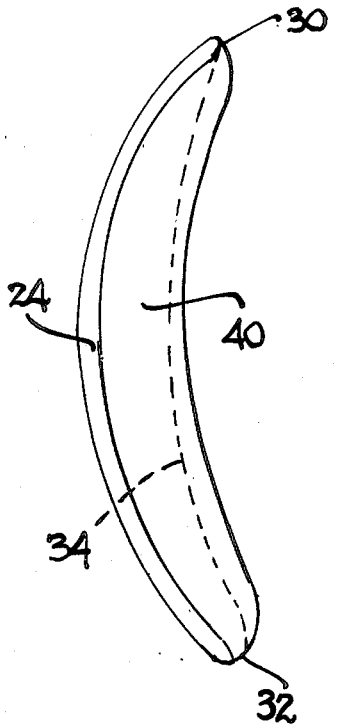
FIG. 3 is a side view of the left foot device of FIG. 1 taken along the line 3—3 in FIG. 2.
Figure 4:
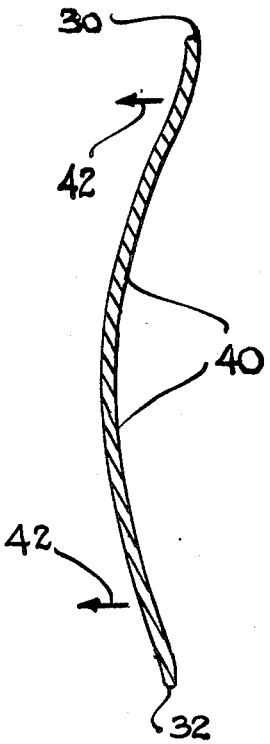
FIG. 4 is a longitudinal sectional view taken along the line 4—4 in FIG. 2.
Figure 5:
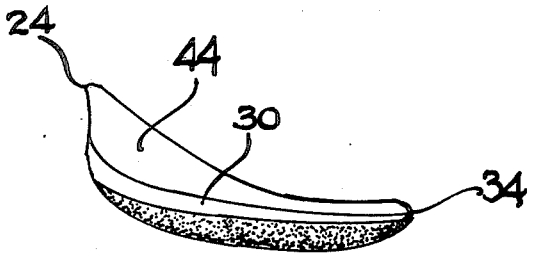
FIG. 5 is a front view of the left foot device of FIG. 1 taken along the line 5—5 in FIG. 2.
Figure 6:
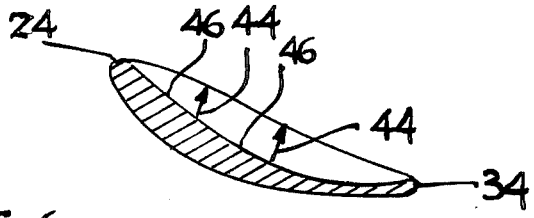
FIG. 6 is a transverse sectional view taken along the line 6—6 in FIG. 2.

Generally speaking, as shown in the drawings, the invention provides a relatively small unitary member 10 which is sized and shaped for removable use inside a conventional shoe without the need for any fastening devices. Of course, where it is deemed necessary in a particular case, a person may nevertheless use a fastener such as adhesive, Velcro or the like, but that is not essential to the invention in its basic form. As best shown in FIG. 1, the length of the member 10 is shortened at both ends to leave the ball portion 12 of the foot as well as the heel portion 14 free and unencumbered without any portion of the arch support device interposed between the plantar surface and the shoe insole except in the area under the instep. In other words, the forward end is truncated so as not to extend beyond a location immediately posterior to the first and fifth metatarsals, and the rearward end is truncated so as not to extend beyond a location immediately anterior to the plantar prominence of the calcaneus.

A central arch portion 16 extends upwardly in order to form a resting bridge in the longitudinal direction as well as a resting bridge in the transverse direction. In reality the central arch portion is a continuous span which is supported in cantilever fashion from a front support base 18, a back support base 20 and a side support base 22, and the medial boundary of the central arch portion is preferably extended to project outwardly in an arc beyond the furthermost portions of the front and back support bases, which projection is designated 24. The aforesaid support bases are located adjacent to the periphery of the device (except there is no support base adjacent to the periphery at 24 along the medial boundary) and provide a stable foundation. The exact shape and dimensions of the central arch may be modified for each person (and for each foot of each person) to provide a custom-fitted arch support device which fairly closely matches the conformation of the plantar section of the instep. In fact, in many instances the arch support device (or foot orthosis as it is often called) is made pursuant to a prescription from a medical doctor, such as an orthopedist, and may be shaped to change or correct the shape of the plantar portion of the foot as formed into a casting by the person making the orthosis. Nevertheless, after much experimentation and changes based on careful monitoring of persons who were wearing orthotic devices in accordance with the inventors' specifications, a number of common features began to emerge as being necessary to provide comfortable, non-aggrevating support in different shoes over extended periods fo time and under a variety of different situations (running, jumping, hiking, prolonged walking, and the like).

One of the features of the present invention is the relatively thin vertical dimension of material throughout the entire device. It was found that in some instances the thickness throughout the entire member 10 could be substantially constant at about 0.06 inches. Any thickness less than that in the materials used for this embodiment created problems of insufficient rigidity and strength.

The perimeter line serves to provide a maximum contact surface for the three support bases 18,20,22 to transmit and dissipate the compression force applied downwardly against the central arch protion 16. In this regard, and more specifically as best shown in FIG. 2, a front edge 30 is preferably shaped to flare forwardly in the direction of the medial side of the plantar; a rear edge 32 is preferably shaped to flare rearwardly in the direction of the medial side of the plantar; and a lateral edge 34 is preferably shaped to arc slightly inwardly. The corners 36 were rounded off to provide added comfort to the person wearing the arch support device.

As a result of the foregoing considerations, the preferred embodiment of the present invention usually has a linear dimension in the longitudinal direction of approximately $4\frac{1}{2}$ inches or less as shown in FIG. 2 at A, and a linear dimension in the transverse direction of approximately 3 inches or less as show at B.

For most persons, and especially those wearing the orthosis who were unusually heavy or else especially inactive, it was found necessary and desirable to provide reinforcement in the medial side of the central arch support portion. Thus, in many instances the thickness was increased to as much as twice the thickness as the rest of the unitary member so that the thicker portion was 0.125 inches thick and the thinner portion was 0.06 inches thick. The added strength was therefore acquired without increasing the overall surface area of the plantar portion directly engaged by the upper surface 46 of the central arch and its support bases 18, 20, 22. Of course, it is to be understood that dimensions given are approximate only and might vary based on the material used to make and shape the unitary member.

In the preferred embodiment, the unitary member is a laminate formed by from three to seven plies of fiberglass impregnated with polyester resin of the thermosetting type. It was found that the combination of a fibrous material with a resin provided the necessary strength and rigidity, while at the same time providing the optional advantage of an appreciable amount of flexure or "give" in order to achieve some pronation. For further comfort, an optional feature is the use of sponge sheeting covering part or all of the top surface and particularly the edge of the support bases. Recent experimentation indicates that only one interply coat of resin may be required, thereby allowing closer packing together of multiple layers of the fiberglass material.

Of course, an epoxy could be substituted for the polyester resin, and initial experimentation with some thermoplastic material shows promise, thereby achieving the preferred shape and strength of the invention without having to laboriously build up a laminate with a plurality of layers of material. However, epoxy is rather slow to gel and might also cause skin rash for some people.

Additional strength against compressional stress was found by making the central arch portion in the shape of a compound curve, i.e., having the surface curve in two or more directions simultaneously. After extensive experimentation it was determined the preferable curvature for achieving this so-called compound curve was having transverse arm components present a concave surface to the plantar portion of the instep, as shown by arrows 44, and longitudinal arm components present a convex surface to the plantar portion of the instep, as shown by arrows 42. This still enabled a top surface 46 to remain in general supporting engagement against the plantar surface without localizing any compressional pressure on a particular section of the instep. Also, this did not interfere with the objective of cantilevering the central arch portion so that the underside surface 40 spanned any crowned arch support built into the shoe.

Since the stabilizing and positioning of a truncated arch support does not occur in most instances by separate fasteners attached to the arch support device, it is an important feature of the invention to extend the side support base 22 to the full breadth of the plantar surface at the midfoot area so that it is interposed between the loadbearing portion of the midfoot (located between the heel and ball of the foot) and the underlying shoe insole. Thus, the thin edges of the unitary member and the contouring as previously described helps to avoid discomfort around the peripheral portions of the device.

What has been shown and described is the preferred version or variously sized and shaped arch support devices which all have certain characteristics found to be necessary to achieve the objectives of the invention, and which were built to be easily inserted into existing shoes with little or no adjustment needed. In that regard, while it is believed that the actual shape of the perimeter of the arch support can be varied, the optimum perimeter design based on present information is the one shown and described, with the linear dimension D along the medial border greater than the linear dimension C along the lateral border.

Based on careful monitoring of experimental versions of the device used by orthopedic patients having various and sundry foot maladies, it was found that the improved arch support could be worn over prolonged periods of time without discomfort, and without injury or damage to either the person wearing the arch support or to the unitary customized support itself. This new orthotic device has proved effective in relieving patients of their symptoms of flatfootedness and hyperpronation. Patients who have had extensive experience with the conventional long orthotic have states that the short thin design of the invention was significantly more comfortable and relief of the symptoms was equal to or better than with the conventional design.

It will be appreciated that various changes, modifications, and substitutions could be adopted in the illustrated embodiment described and shown without departing from the scope of the present invention as set forth in the claims below. In that regard, applicants are continuing to experiment with refinements in the structure, shape and materials used in the orthotics of the present invention, including the use of fiberglass cloth layed down on the bias, specifically different types of polyester resins, and thermoplastic and thermosetting materials which would hopefully be formed in a single step (rather than the sequential laminating steps currently be used) into the uniquely sized and shaped unitary member of the invention which in its simplified way provides more advantages over periods of long use than has heretofore been possible.

We claim as our invention:

1. An arch support device without any foot encircling band and which is designed for use as a removable shoe insert for treatment of temporary or chronic foot disorders including:

a unitary member truncated at its forward end to terminate posterior to the heads of the first and fifth metatarsals to leave the ball of the foot in contact with the shoe insole without any interference from the device and which is also truncated at its rearward end to terminate anterior to the plantar prominence of the calcaneus to leave the heel of the foot in contact with the shoe insole without any interference from the device, said unitary member being formed by a relatively thin layer of substantially rigid material which extends transversely from the medial side of the plantar surface of the foot continuously to the opposite lateral side of the plantar surface, and which includes a central arch means for holding both the longitudinal and transverse dimensions of the arch of the foot in a predetermined raised position relative to the ball and heel of the foot, with said central arch means cantilevered in a suspended position to form a bridge which is spaced above the shank portion of the shoe from support bases which directly contact the shoe insole, with said support bases located only along peripheral portions of said unitary member to eliminate the thick bulk of compressible cushion which usually fills the space between the plantar of the foot and the insole of the shoe, thereby preventing excessive pronation of the foot while transferring some of the body and leg weight through the peripheral support bases to the underlying shoe insole.

2. The device of claim 1 wherein said support bases include a side support base located along the lateral side of the plantar surface of the foot and interposed between the midfoot and the shoe insole, and wherein there is no support base located along the medial side of the plantar surface of the foot thus leaving said central arch means cantilevered in a suspended position spaced above the shoe shank.

3. The device of claim 2 wherein said side support base extends substantially to the lateral boundary of the plantar surface of the foot.

4. The device of claim 2 wherein said support bases include a front support base interposed between the plantar surface of the foot and the shoe insole just posterior to the ball of the foot, and a back support base interposed between the plantar surface of the foot and the shoe insole just anterior to the heel pad of the foot.

5. The device of claim 4 wherein said unitary member has an outwardly projecting boundary along the medial side of the plantar surface which arcs beyond the furthermost portions of said front and back support bases adjacent the medial side of the plantar surface of the foot.

6. The device of claim 1 wherein said central arch means includes a plurality of transverse arm components which when viewed as a cross-section present a concave arch support against the underside of the instep of the foot.

7. The device of claim 1 wherein said central arch means includes a plurality of longitudinal arm components which when viewed as a cross-section present a convex arch support against the underside of the instep of the foot.

8. The device of claim 1 wherein said central arch means includes reinforcing means within the portion of said unitary member which is cantilevered in a suspended position spaced above the shoe shank adjacent the medial side of the plantar for strngthening the device.

9. The device of claim 1 wherein said unitary member includes stabilizing means extending to the full breadth of the plantar surface at its lateral side for prepositioning the device without the need of any attachments to the foot or shoe and for maintaining such positions without any significant tilting when the arch portion of the foot is subjected to the compression forces exerted downwardly through the instep of the foot during periods of exercise or work by the person wearing the device in the shoe.

10. The device of claim 8 wherein said reinforcement means constitutes a thickened layer of substantially rigid material forming said central arch means cantilevered in a suspended position spaced above the shank portion of the shoe while still leaving said device substantially thinner along its peripheral edges.

11. An arch support device which is designed for use as a removable shoe insert for treatment of temporary or chronic foot disorders including:

a unitary member truncated at its forward and rearward ends to leave the ball and heel of the foot in contact with the shoe insole without any interference from the device, said unitary member being formed of a non-compressible thin body which holds its shape and thickness when subjected to the stresses and strains applied from above by the foot as well as applied from below by the shoe, said unitary member including a central arch portion cantilevered in a suspended position to be spaced above the shank portion of the shoe and further including peripheral base means located adjacent all the boundaries of said unitary member except for the boundary along the medial side of the foot for holding said central arch portion like a bridge against the underside of the instep of the foot to eliminate any thick bulk of cushiony material which usually fills the space between the plantar of the foot and the insole of the shoe.

12. The device of claim 11 wherein said central arch portion is shaped to form a compound curve when viewed as a cross-section including a plurality of longitudinal arm components which are suspended above the shank portion of the shoe to present a convex arch support against the underside of the instep of the foot and a plurality of transverse arm components which are suspended above the shank portion of the shoe to present a concave arch support against the underside of the instep of the foot.

* * * * *